US006638174B1

(12) United States Patent
Ford

(10) Patent No.: US 6,638,174 B1
(45) Date of Patent: Oct. 28, 2003

(54) APPARATUS AND METHOD FOR PUTTING PRACTICE

(76) Inventor: Brendon Ford, 29 Reita Avenue, Wantirna South, Victoria 3152 (AU)

( * ) Notice: Subject to any disclaimer, the term of this patent is extended or adjusted under 35 U.S.C. 154(b) by 0 days.

(21) Appl. No.: 09/979,114

(22) PCT Filed: May 31, 2000

(86) PCT No.: PCT/AU00/00621

§ 371 (c)(1),
(2), (4) Date: Feb. 4, 2002

(87) PCT Pub. No.: WO00/72924

PCT Pub. Date: Dec. 7, 2000

(30) Foreign Application Priority Data

Jun. 1, 1999 (AU) ..... PQ2117
Apr. 12, 2000 (AU) ..... PQ6854

(51) Int. Cl.[7] ..... A63B 69/36

(52) U.S. Cl. ..... 473/184; 473/180; 473/162; 473/163

(58) Field of Search ..... 473/150, 157–164, 473/166, 170–174, 180–182, 184–186, 191, 194–196; D21/790

(56) References Cited

U.S. PATENT DOCUMENTS 1,773,813 A * 8/1930 Gourlay et al. ..... 473/185
2,716,029 A * 8/1955 Montgomery ..... 473/184
2,988,362 A * 6/1961 Brewer ..... 473/184
D211,651 S * 7/1968 Cohen ..... D21/790
4,573,686 A 3/1986 Nakamats
4,728,106 A * 3/1988 Shore ..... 473/180
5,087,046 A * 2/1992 Mauch ..... 473/180
5,165,690 A * 11/1992 Kelley, Jr. ..... 473/184
5,505,451 A * 4/1996 Brayshaw ..... 473/163
5,586,941 A 12/1996 Klearman
5,630,719 A * 5/1997 Franklin ..... 434/252

FOREIGN PATENT DOCUMENTS

JP 10113412 A 5/1998
JP 11047336 A 2/1999

* cited by examiner

*Primary Examiner*—Mark S. Graham
(74) *Attorney, Agent, or Firm*—Larson & Taylor, PLC

(57) ABSTRACT

An apparatus for golf putting practice including a golf ball return sheet with a trough running from a lower first end of the sheet to an upper second end of the sheet and along a center line. The first end is for locating on a putting surface and a support supports the sheet inclined to the putting surface. The support has an upwardly extending wall to stop a ball, and the ball will then roll back down the trough of the sheet. The upwardly extending wall can also have a small target aperture and semi-circular tongue. The apparatus can be returned to a flat condition for storage purposes.

14 Claims, 5 Drawing Sheets

APPARATUS AND METHOD FOR PUTTING PRACTICE

FIELD OF THE INVENTION

The present invention relates to an apparatus and method for practicing golf putting.

DESCRIPTION OF RELATED ART

Existing apparatuses for practising putting include a convex plate, provided with a central depression and a rear wall. Such devices are placed on the floor and a user attempts to putt a golf ball into the depression. The rear wall is provided to prevent golf balls from overshooting the device: this minimizes the movement required to retrieve the ball. A more complex device includes a return mechanism, whereby any golf ball entering the device is channelled towards a piston or lever which is activated by the ball's presence to propel the ball from a race or chute, generally located in the front of the device.

The former device described above has the advantage of simplicity, but golf balls are not returned to the user. This is overcome in the second device, but with considerable complexity and expense. It is also necessary to power the return mechanism, often by electrical battery or with a manually wound clockwork mechanism.

SUMMARY OF THE INVENTION

Further, existing devices do not return the golf balls in the general direction of the user.

According to the present invention, therefore, there is provided an apparatus for putting practice comprising:

a golf ball return surface having a downwardly concave curved trough running from a first end of said return surface to a second end of said return surface, said first end for locating on a putting surface; and support means for supporting said return surface so as to be inclined to said putting surface with said second end above said putting surface.

Preferably the first end is curved so that said return surface more readily forms extended contact with said putting surface when said return surface is located on and inclined to said putting surface.

Thus, the inclined surface provides a surface against which a user may putt a ball, and from which the ball will roll back towards the user. The trough biases the direction of the ball's return towards the user, whether or not the ball hits the apparatus centrally. The first end is preferably curved so that—especially when the material from which the apparatus is made is relatively stiff—it will be in extended contact with the putting surface, ideally with the edges of the first end in contact with the putting surface. If the material is somewhat softer, the weight of the return surface may be sufficient to provide this extended contact, as this weight will deform the otherwise unsupported edges into contact with the putting surface.

Preferably the apparatus is provided with an indicium at or adjacent to said first end and located centrally thereto as a target for aiming a ball towards.

This indicium makes it clearer to the user where he or she should aim the ball (and serves as the notional hole).

Preferably the apparatus includes a target aperture for fully or partially receiving said golf ball.

Preferably said apparatus includes a back wall, most preferably at or adjacent to said second end.

Thus, balls hit with excessive force may nevertheless be returned to the user.

Preferably said support means engages said return surface at or adjacent to said second end. Preferably said support means comprises a curved sheet.

Preferably said support means and said back wall are integrally formed and/or said back wall is an extension of said support means.

Preferably the apparatus includes retaining means for engaging said return surface and said back wall, and thereby to retain said return surface and said back wall in correct relative position. Preferably the retaining means is provided in said back wall.

Preferably said apparatus is integrally constructed, and more preferably flattenable for ease of storage or transportation.

In one specific aspect, the present invention provides a substantially flat sheet scored, ruled and/or perforated for folding into an apparatus as described above.

According to a further aspect, the present invention provides a method for practising putting involving:

putting a ball along a putting surface towards a first end located on said putting surface of an inclined return surface and upwardly along said return surface generally towards a second, raised end of said return surface, said return surface including a downwardly concave curved trough running from said first end to said second end; and allowing said return surface to return said ball;

whereby said ball is directed, upon rolling back down said return surface, generally towards a user owing to said trough.

Preferably said first end is curved so that said return surface more readily forms extended contact with said putting surface.

Preferably said method includes aiming at a target aperture provided in or adjacent said raised end of said return surface.

BRIEF DESCRIPTION OF THE DRAWINGS

In order that the present invention may be more clearly ascertained, a preferred embodiment will now be described, by way of example, with reference to the accompanying drawing, in which.

DESCRIPTION OF THE PREFERRED EMBODIMENTS

Figure 1:
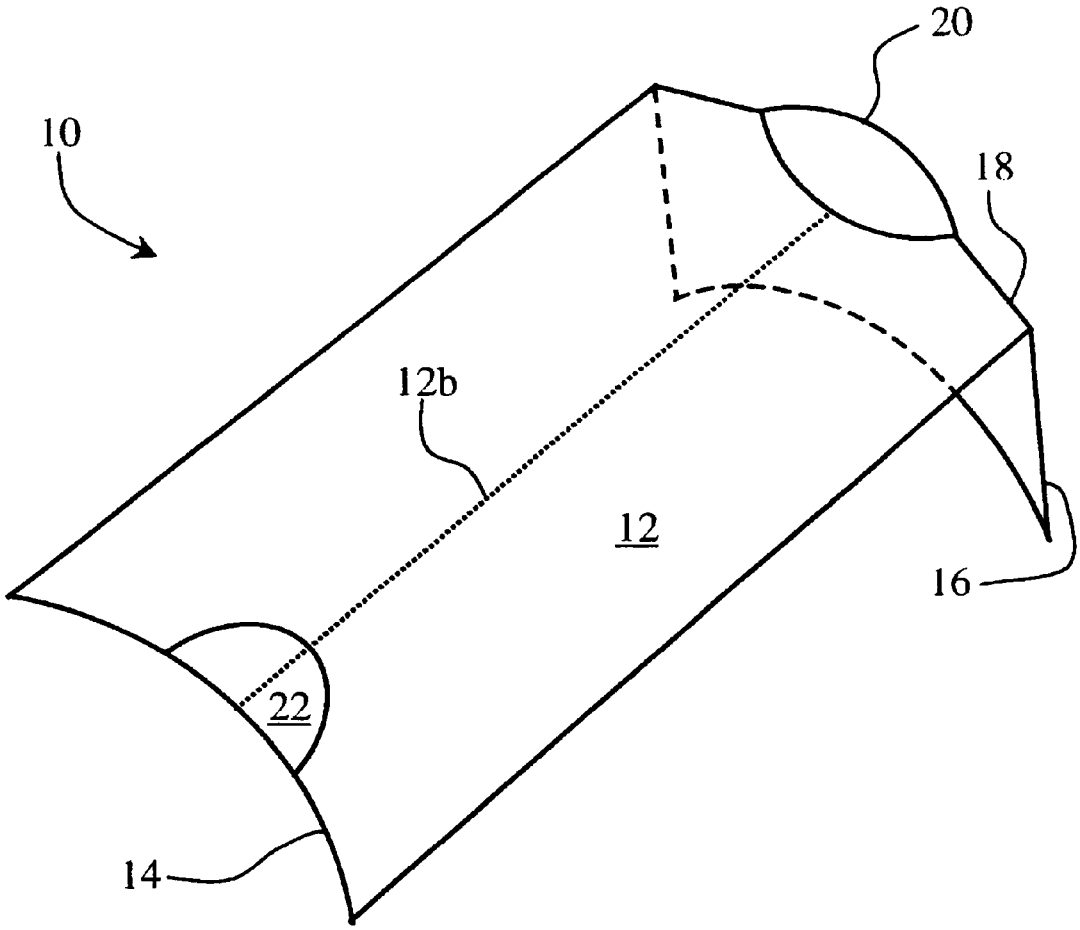
FIG. 1 is a perspective view of a putting aid according to a preferred embodiment of the present invention.

A putting aid in accordance with a preferred embodiment of the present invention is shown generally at 10 in FIG. 1. The aid 10 includes a downwardly troughed inclined sheet 12 of stiff card. The first, lower end 14 of sheet 12 is concave so that, when the aid 10 is placed upon a flat surface, lower end 14 will be in contact with that surface despite the troughed profile of sheet 12.

The putting aid 10 also includes a curved support 16 located at second or upper end 18 of sheet 12. Support 16 includes an upwardly extending wall 20 which projects above sheet 12.

Sheet 12 further includes an indicium in the form of a crescent-shaped region 22 adjacent to first end 14.

Figure 2:
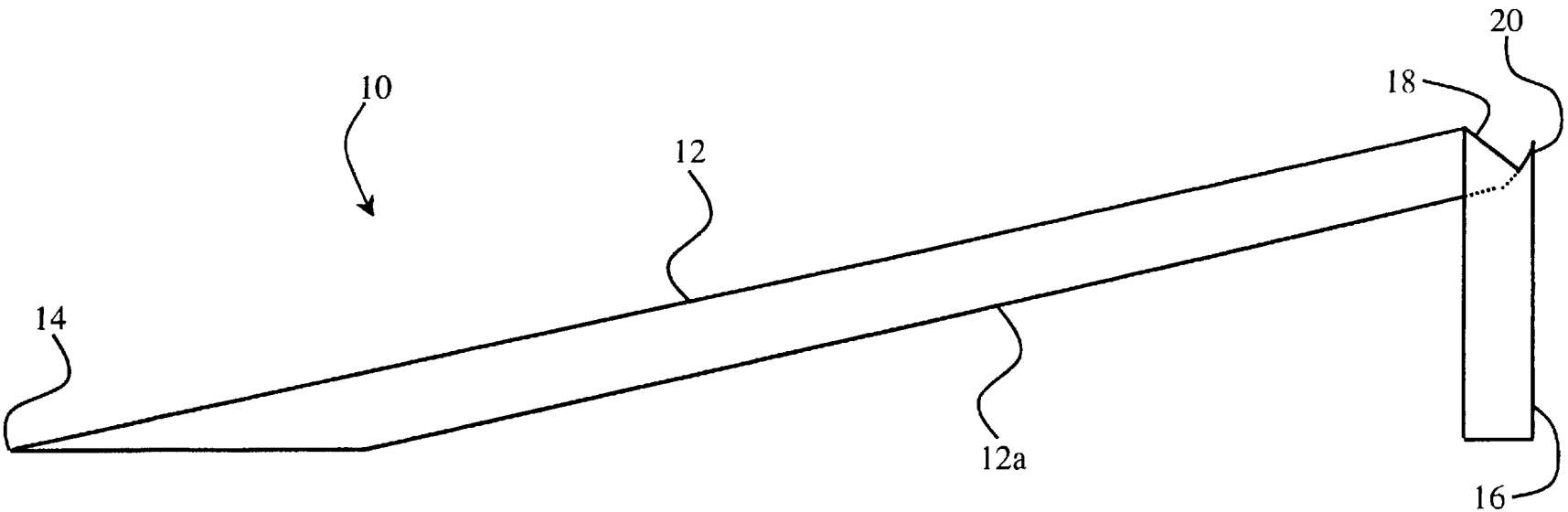
FIG. 2 is a side elevation of the putting aid of FIG. 1.

FIG. 2 is a side elevation of the putting aid 10. The troughed nature of sheet 12 is readily apparent in this view; the lower peripheral 12*a* corresponds to the longitudinal centre line 12*b* of the sheet 12.

In use, the putting aid 10 is placed on a suitable playing surface, and a user practises putting by putting a golf ball towards region 22 and hence upwardly along sheet 12. If a golf ball is hit with excessive force, wall 20 will in many instances stop the ball, and the ball will then roll back down sheet 12. Otherwise, the ball will roll some distance upwardly along sheet 12, and then roll back down sheet 12 and from the aid 10 towards the user.

Advantageously, if the user hits the golf ball from a location aligned with mid-line 12*b* of sheet 12, but misses target region 22, the troughed form of sheet 12 will tend to redirect the golf ball back towards mid-line 12*b* and therefore return the ball to the vicinity of the user. Alternatively, if the user hits the ball towards the putting aid 10 from a position that is not aligned with mid-line 12*b*, the troughed form of sheet 12 means that the ball will nevertheless encounter a similar gradient to one hit from an aligned position, and so be again returned to the general vicinity of the user.

Figure 3:
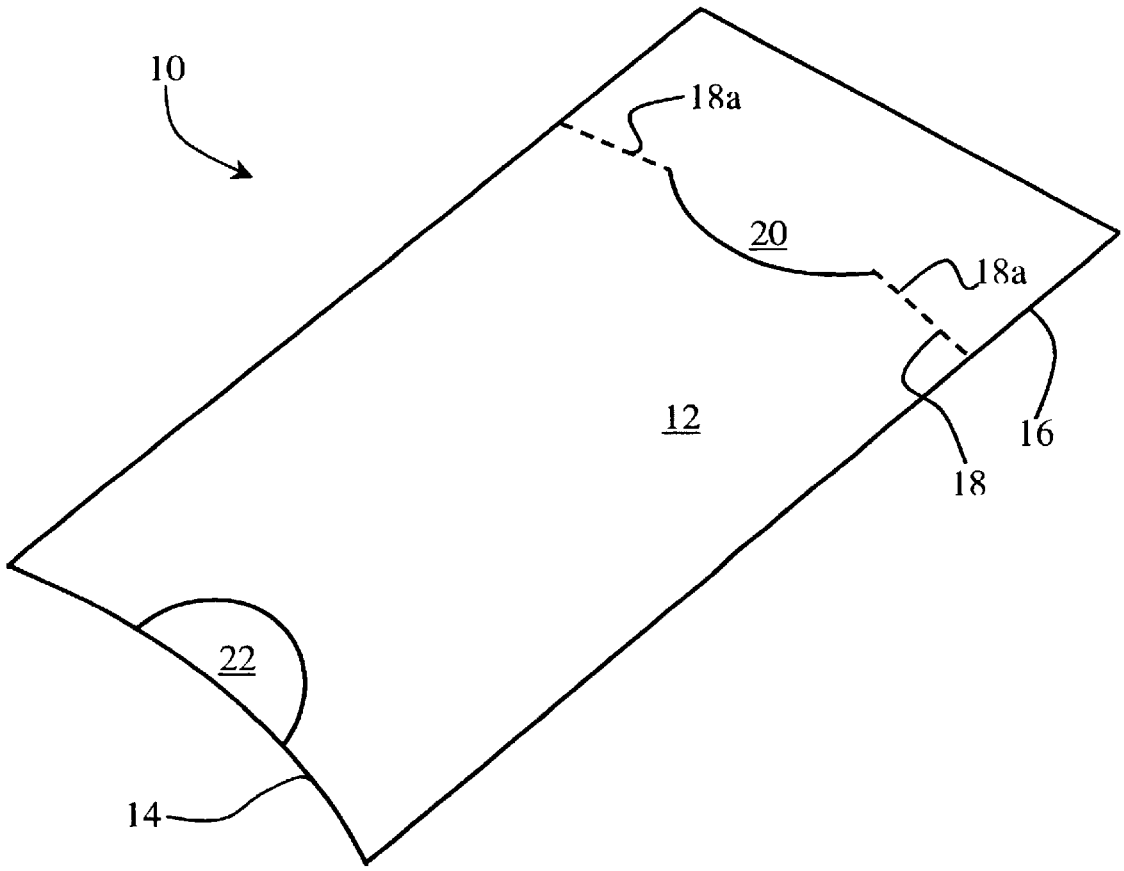
FIG. 3 is a view of the aid of FIG. 1 folded flat.

FIG. 3 shows the putting aid 10 of FIGS. 1 and 2 folded flat. It can be seen in this figure that the second end 18 is formed when the flattened aid 10 is folded along dashed lines 18*a* (which are preferably scored). These lines are not co-linear or parallel, and so folding support 16 downwards forces sheet 12 into the troughed configuration shown in FIGS. 1 and 2. This also lifts wall 20 into its upward position, as also shown in FIGS. 1 and 2.

Once folded into the configuration shown in FIGS. 1 and 2, the putting aid 10 will stand without assistance on a surface, such as carpet, with sufficient friction. However, on smoother surfaces, such as a wooden floor, it may be necessary to maintain support 16 and sheet 12 in the relative configuration shown in FIGS. 1 and 2 by means of tape or some other elongate element attached, preferably, from the lower extremity of support 16 to the under-side of sheet 12. This may be unnecessary in other embodiments where the entire putting aid is moulded from, for example, plastic, or made of some other material such as light steel sheet that would resist collapsing flat. However, such embodiments would lack the advantage of that illustrated in FIGS. 1 to 3 of being able to be folded flat for storage or transport.

Figure 4:
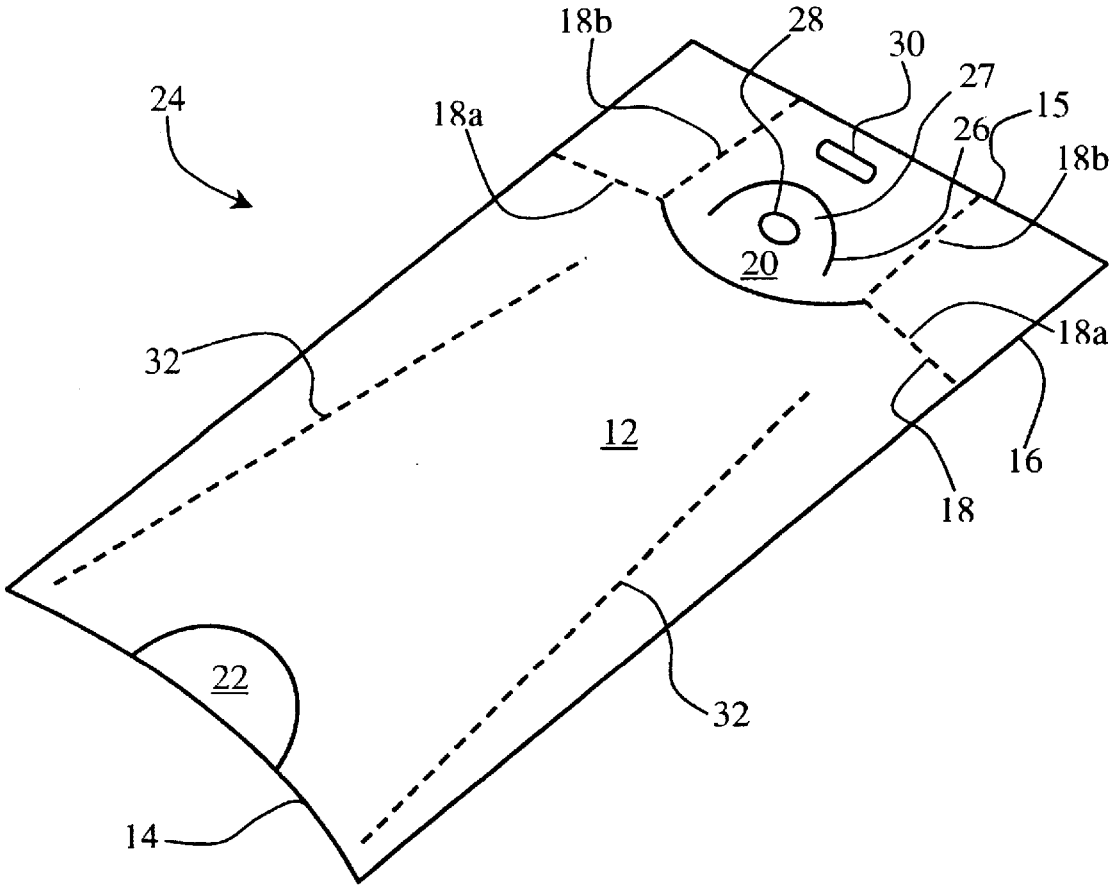
FIG. 4 is a perspective view of a putting aid according to a further preferred embodiment of the present invention view folded flat.

A putting aid in accordance with a further preferred embodiment of the present invention is shown generally at 24 in FIG. 4, which is a perspective view of the putting aid 24 folded flat. Putting aid 24 is generally similar to the putting aid 10 described above; like numerals indicate like features.

Putting aid 24 is of polypropylene of approximately 1.4 mm thickness. It differs from putting aid 10 in that lower end 14 is considerably less curved (and, in fact, is optionally straight) and is provided with additional score lines to assist the assembly process. In putting aid 24 dashed lines 18*a* indicate score lines, and additional score lines 18*b* are provided from the inner ends of score lines 18*a* to end 15 (that is, the end opposite lower end 14). Score lines 18*b* marginally converge as they run from score lines 18*a* to end 15. In addition, sheet 12 includes two score lines 32, each from near (approximately 2 cm) a respective lower corner 14*a* of sheet 12, to the point at which a respective pair of score lines 18*a*, 18*b* intersect, but ending—in each case—approximately 9 cm from that point of intersection.

These score lines encourage the putting aid 24 to bend along score lines 18*a*, 18*b* and 32 so that—when the putting aid 24 is assembled—the preferred configuration (shown in FIG. 5) is obtained. The use of this combination of score lines, moreover, reduces the force required by a user to effect this assembly.

Putting aid 24 also includes an approximately semi-circular cut 26 located adjacent to (or, when assembled, below) end wall 20. This cut 26 defines a retaining means in the form of semi-circular tongue 27 which, when the putting aid 24 is assembled, engages sheet 12 resiliently and thereby maintains the assembled configuration without requiring additional support (such as the elongate element referred to above). An elliptical target aperture 28 is provided adjacent to the centre of curvature of cut 26. Target aperture 28 is smaller than a golf ball, but large enough to represent a realistic target for the user, as will be described in more detail below.

The putting aid 24 also includes, near end 15, a hanging aperture 30 so that putting aid 24 can be stored folded flat and hanging from a hook.

Figure 5:
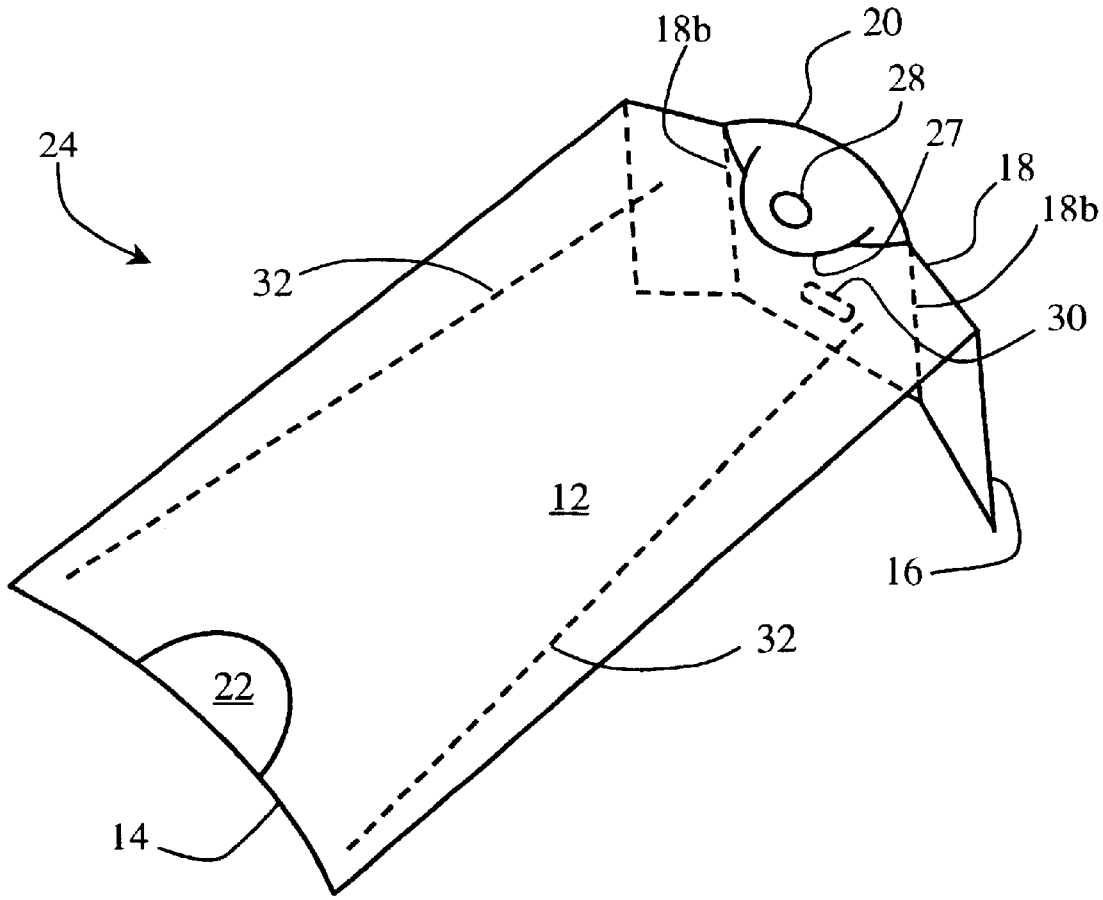
FIG. 5 is a perspective view of the putting aid of FIG. 4 in assembled configuration.

Referring to FIG. 5, putting aid 24 is assembled by folding the putting aid 24 along the various score lines, so that sheet 12 forms a trough and upper end 18 of sheet 12 is supported above a playing surface by support 16, resting on end 15. Tongue 27 (at this point projecting downwardly) is bent forwards (i.e. towards lower end 14) and upwards until impeded by the underside of sheet 12, then bent through the gap between support 16 and sheet 12 and released thereby pressing resiliently downwards against sheet 12 and urging wall 20 away from sheet 12. As wall 20 extends above sheet 12, this, in effect, applies a moment to wall 20 and thereby support 16 that maintains the putting aid 24 in the assembled configuration shown in FIG. 5.

In this configuration, target aperture 28 is located marginally beyond the upper periphery of sheet 12.

A user can use putting aid 24 essentially in the same manner as he or she would use putting aid 10. In addition, however, the user can aim a golf ball at target aperture 28 and, if the ball is hit in the appropriate direction and (unlike putting aid 10) with the appropriate force, the ball will stop in target aperture 28. The provision, therefore, of target aperture 28 provides an additional form of practice for the user that depends on the force with which a ball is struck as well as the direction in which the ball is hit. The ball can then be dislodged by an appropriately struck subsequent ball.

When the user has complete his or her putting practice, tongue 27 can be pushed downwardly past sheet 12, thereby releasing the urging of wall 20 and support 16 into the assembled configuration and allowing the putting aid 24 to be again folded flat as shown in FIG. 4.

Modifications within the spirit and scope of the invention may readily be effected by a person skilled in the art. Consequently, it is to be understood that the invention is not limited to the particular embodiments described by way of example hereinabove.

The claims defining the invention are as follows:

1. An apparatus for putting practice comprising:

a golf ball return surface having a first end and a second end; and a support means for supporting said return surface at said second end;

wherein said return surface and said support means meet at least in part along at least one fold line such that (a) said apparatus can be flattened, and (b) folding said apparatus along said at least one fold line induces said return surface to form a downwardly concave curved trough running from said first end to said second end, and wherein said first end is locatable on a putting surface with said support means supporting said second end above the putting surface so that said return surface is inclined to the putting surface.

2. An apparatus as claimed in claim 1, wherein said first end is curved so that said return surface more readily forms extended contact with the putting surface when said return surface is located on and inclined to the putting surface.

3. An apparatus as claimed in either claim 1, wherein said apparatus is provided with an indicium at or adjacent to said first end and located centrally thereto as a target for aiming a ball towards.

4. An apparatus as claimed in claim 1, including a target aperture for fully or partially receiving a golf ball.

5. An apparatus as claimed in claim 1, wherein said apparatus includes a back wall.

6. An apparatus as claimed in claim 5, wherein said back wall is at or adjacent to said second end.

7. An apparatus as claimed in either claim 5, wherein said support means and said back wall are integrally formed and/or said back wall is an extension of said support means.

8. An apparatus as claimed in claim 5, including retaining means for engaging said return surface and said back wall, and thereby to retain said return surface and said back wall in correct relative position.

9. An apparatus as claimed in claim 8, wherein said retaining means is provided in said back wall.

10. An apparatus as claimed in claim 1, wherein said support means engages said return surface at or adjacent to said second end.

11. An apparatus as claimed in claim 1, wherein said support means comprises a curved sheet.

12. An apparatus as claimed in claim 1, wherein said apparatus is integrally constructed.

13. An apparatus as claimed in claim 1, including a target aperture for fully or partially receiving a golf ball, a back wall and retaining means for engaging said return surface and said back wall to retain said return surface and said back wall in correct relative position, wherein said target aperture is provided in said back wall.

14. An apparatus for putting practice comprising:

a substantially flat sheet scored, ruled and/or perforated for folding into an apparatus as claimed in claim 1.

* * * * *